US006755756B2

(12) United States Patent
Sung

(10) Patent No.: US 6,755,756 B2
(45) Date of Patent: Jun. 29, 2004

(54) DEVICE FOR DEADENING NOISE AND ABSORBING SHOCK OF TENNIS RACKET STRINGS

(76) Inventor: Hung-Fu Sung, No. 17, Lane 210, Chung Yang Rd., Feng Yuan, Taichung Hsien (TW)

( * ) Notice: Subject to any disclaimer, the term of this patent is extended or adjusted under 35 U.S.C. 154(b) by 174 days.

(21) Appl. No.: 10/211,541

(22) Filed: Aug. 5, 2002

(65) Prior Publication Data

US 2004/0023738 A1 Feb. 5, 2004

(51) Int. Cl.[7] ..... A63B 49/00
(52) U.S. Cl. ..... 473/522
(58) Field of Search ..... 473/520, 521, 473/522, 553

(56) References Cited

U.S. PATENT DOCUMENTS 4,761,007 A * 8/1988 Boschian ..... 473/522
4,927,143 A * 5/1990 Hillock ..... 473/522
5,651,545 A * 7/1997 Nashif et al. ..... 473/520
5,871,409 A * 2/1999 Kimoto ..... 473/522
5,964,672 A * 10/1999 Bianchi ..... 473/521
6,033,324 A * 3/2000 Nashif et al. ..... 473/520
6,447,411 B1 * 9/2002 Bianchi ..... 473/522

FOREIGN PATENT DOCUMENTS

FR 2554723 * 5/1985 ..... 473/FOR 178
GB 2135588 * 9/1984 ..... 473/FOR 178

* cited by examiner

*Primary Examiner*—Raleigh W. Chiu
(74) *Attorney, Agent, or Firm*—Dennison, Schultz & Dougherty

(57) ABSTRACT

A device comprises an elastomer, and a metal ball which is contained in a cell of the interior of the elastomer. The elastomer is provided in the periphery with one or more slits by which the elastomer is fastened to the strings of a tennis racket. The elastomer in itself is capable of absorbing shock and deadening noise. As the strings of the tennis racket are impacted by a ball, the metal ball is activated by the impact force to vibrate at a high frequency in the cell of the elastomer. The high-frequency vibration of the metal ball serves to absorb shock and deaden noise.

1 Claim, 5 Drawing Sheets

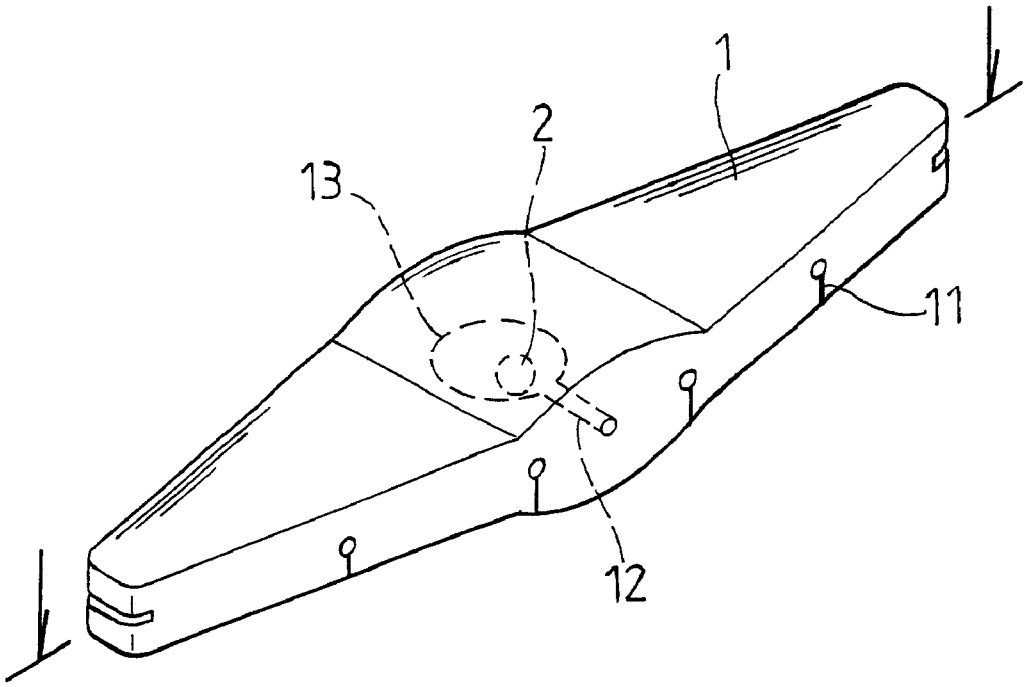
Fig・1

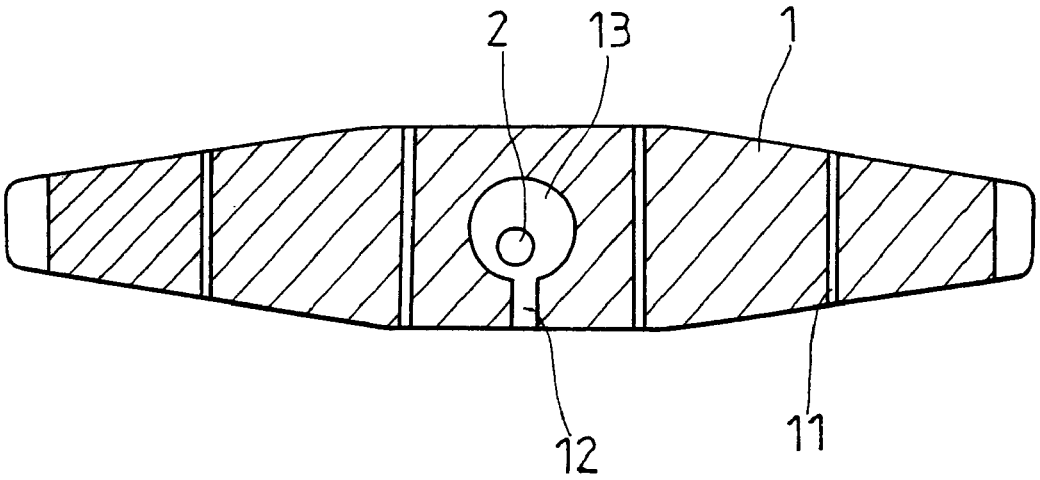
Fig・2

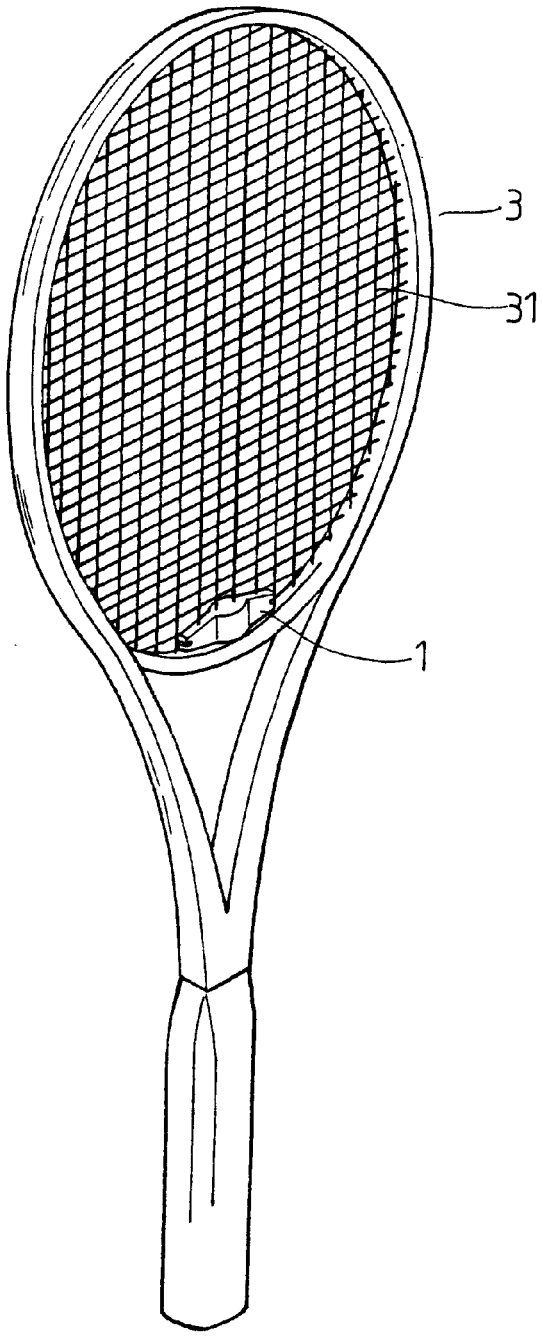
Fig・3

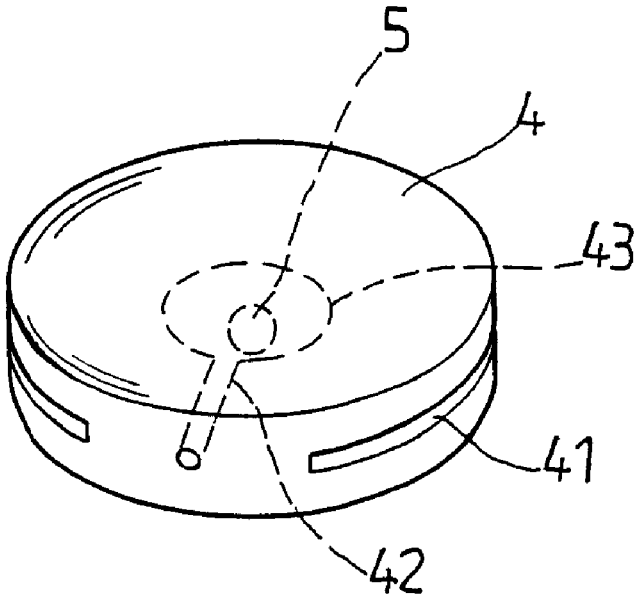
Fig • 4

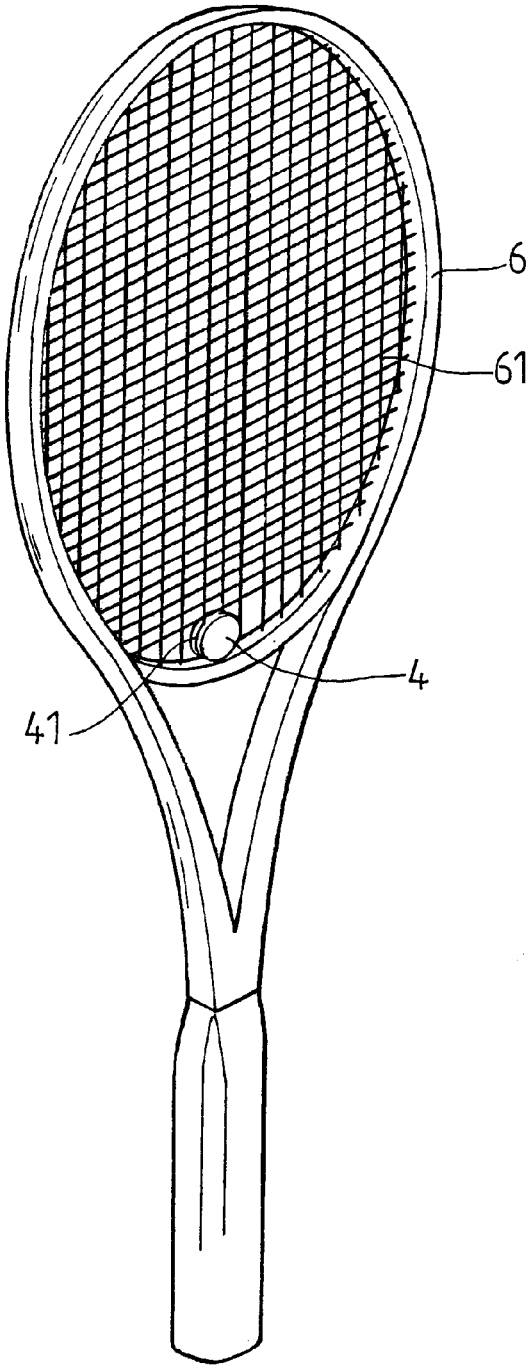
Fig・5

DEVICE FOR DEADENING NOISE AND ABSORBING SHOCK OF TENNIS RACKET STRINGS

FIELD OF THE INVENTION

The present invention relates generally to a tennis racket, and more particularly to a device which is fastened to the strings of the tennis racket for deadening noise and absorbing shock of the strings upon being impacted by a ball.

BACKGROUND OF THE INVENTION

The conventional shock absorber of a tennis racket is generally designed as an integral part of the tennis racket, thereby resulting in an added structural complexity to the tennis racket as well as an increase in production cost of the tennis racket. In addition, the conventional shock absorber has a limited effect on mitigating the impact of a ball on the tennis racket strings.

SUMMARY OF THE INVENTION

The primary objective of the present invention is to provide a low-cost device which is fastened to the strings of a tennis racket for deadening noise and absorbing shock of the tennis racket strings.

In keeping with the principle of the present invention, the foregoing objective of the present invention is attained by the device comprising an elastomer and a metal ball. The elastomer is provided in the interior with a cell, and in the periphery with one or more slits. The metal ball is received in the cell of the elastomer. The metal ball is attached to the strings of a tennis racket in such a manner that the strings are retained in the slits of the elastomer. When the strings are impacted by a ball, the metal ball is caused by the impact force to vibrate at a high frequency in the cell of the elastomer. The high frequency vibration of the metal ball serves to deaden noise and absorb shock.

The features, functions, and advantages of the present invention will be more readily understood upon a thoughtful deliberation of the following detailed description of the preferred embodiments of the present invention with reference to the accompanying drawings.

BRIEF DESCRIPTION OF THE DRAWINGS

FIGS. 1 shows a perspective view of a first preferred embodiment of the present invention.

FIGS. 2 shows a longitudinal sectional view of the first preferred embodiment of the present invention.

FIGS. 3 shows a schematic view of the first preferred embodiment of the present invention in use.

FIG. 4 shows a perspective view of a second preferred embodiment of the present invention.

FIG. 5 shows a schematic view of the second preferred embodiment of the present invention in use.

DETAILED DESCRIPTION OF THE PREFERRED EMBODIMENTS

As shown in FIGS. 1 and 2, a device of the present invention comprises an elastomer 1 and a metal ball 2.

The elastomer 1 is provided in the interior of a center portion thereof with a cell 13 and a canal 12 in communication with the cell 13 and the atmospheric air. The cell 13 is dimensioned to contain the metal ball 2, which is forced into the cell 13 via the canal 12 and is capable of vibrating in the cell 13 under the influence of an external force.

The preparation of the elastomer 1 involves the use of an upper mold, a lower mold, and a needle-shaped body which is disposed in the lower mold. The needle-shaped body has a head and a shank extending from the head. The cell 13 of the elastomer 1 is formed by the head of the needle-shaped body, while the canal 12 of the elastomer 1 is formed by the shank of the needle-shaped body. As a result of removal of the needle-shaped body, the canal 12 and the cell 13 are formed.

As shown in FIG. 2, the elastomer 1 is provided with a plurality of slits 11 parallel to one another and extending in a direction perpendicular to the longitudinal direction of the elastomer 1. The slits 11 are used to accommodate strings 31 of a tennis racket 3, as shown in FIG. 3. In another words, the elastomer 1 is fastened to the strings 31 of the tennis racket 3 by the slits 11 such that the elastomer 1 is contiguous to the neck of the tennis racket 3.

As the strings 31 of the tennis racket 3 are impacted by a ball, the metal ball 2 is activated by the impact force to vibrate at a high frequency in the cell 13 of the elastomer. The high-frequency vibration of the metal ball 2 serves to deaden noise and absorb shock, thereby resulting in reduction in transmission of the shock wave to the handle from the head frame of the tennis racket 3.

As shown in FIG. 4, a device of the second preferred embodiment of the present invention is basically similar in construction to that of the first preferred embodiment described above, with the difference being that the former comprises a round elastomer 4 which is provided in the interior with a cell 43, and a canal 42 in communication with the cell 43 and the atmospheric air. The round elastomer 4 is further provided in the periphery with a continuous slit 41 by means of which the elastomer 4 is fastened to the strings 61 of a tennis racket 6, as shown in FIG. 5. A metal ball 5 is forced into the cell 43 via the canal 42. The metal ball 5 of the second preferred embodiment is akin in function to the metal ball 2 of the first preferred embodiment.

It must be noted here that the elastomer 1 or 4 of the present invention in itself is capable of absorbing shock and deadening noise. It is therefore readily apparent that the present invention is relatively more effective than the prior art devices, thanks to the elastomer and the metal ball.

The embodiment of the present invention described above are to be construed in all respects as being illustrative and nonrestrictive. Accordingly, the present invention may be embodiment in other specific forms without deviating from the spirit thereof. The present invention is therefore to be limited only by the scope of the following claim.

What is claimed is:

1. A device for deadening noise and absorbing shock of the strings of a tennis racket, said device comprising:

an elastomer of a form and provided in an interior with a cell, and a canal in communication with said cell and atmospheric air, said elastomer further provided in a periphery with one or more slits whereby said elastomer is fastened with the strings of the tennis racket by said slits serving to accommodate the strings of the tennis racket; and a metal ball inserted into said cell of said elastomer via said canal whereby said metal ball is activated to vibrate at a high frequency in said cell of said elastomer by the impact of a tennis ball in contact with the strings of the tennis racket.

* * * * *